United States Patent [19]

Kistner

[11] Patent Number: 4,534,753

[45] Date of Patent: Aug. 13, 1985

[54] METHOD OF FORMING INTERMEDIATE FOLDED BLANKS FOR CENTER SPECIAL SLOTTED CONTAINERS

[75] Inventor: Oscar J. Kistner, Cincinnati, Ohio

[73] Assignee: The Mead Corporation, Dayton, Ohio

[21] Appl. No.: 559,672

[22] Filed: Dec. 9, 1983

Related U.S. Application Data

[62] Division of Ser. No. 317,103, Nov. 2, 1981, Pat. No. 4,477,002.

[51] Int. Cl.[3] ..... B31B 1/26; B31B 1/62

[52] U.S. Cl. ..... 493/453

[58] Field of Search ..... 229/37 R, 37 E, 38, 229/41 B; 493/436, 442, 453

[56] References Cited

U.S. PATENT DOCUMENTS

| | | | |
|---|---|---|---|
| 235,682 | 12/1880 | Housum | 229/37 R |
| 940,667 | 11/1909 | Bird | 229/37 R |
| 1,146,516 | 7/1915 | Potter | 229/37 R |
| 2,562,579 | 7/1951 | Ringler | 229/37 E |
| 3,771,714 | 11/1973 | Faires et al. | 229/37 R |

FOREIGN PATENT DOCUMENTS

| | | | |
|---|---|---|---|
| 1458051 | 12/1976 | United Kingdom | 229/37 R |

*Primary Examiner*—E. Michael Combs

*Attorney, Agent, or Firm*—Biebel, French & Nauman

[57] ABSTRACT

A structure for use in assembly of a non-square center special slotted container is constructed from a single piece, five panel blank having a full end panel, two side panels, and two partial end panels, each having associated flaps, which is folded to produce overlapping of the partial end panels. The end flaps extending from the partial end panels, and the correspondingly disposed flaps extending from the full end panel each are of a length substantially equal to one-half the length of the front and rear side panels. The full and partial end flaps are of equal length on each side of the blank so that contact of the outer edges of the folded blank by platens or other means in the squaring station of a folder-gluer machine properly aligns the blank and consistently produces properly squared and sealed folded blanks.

5 Claims, 17 Drawing Figures

METHOD OF FORMING INTERMEDIATE FOLDED BLANKS FOR CENTER SPECIAL SLOTTED CONTAINERS

This is a division of application Ser. No. 317,103, filed Nov. 2, 1981, U.S. Pat. No. 4,447,002.

BACKGROUND OF THE INVENTION

1. Field of the Invention

The present invention relates to center special slotted containers, and in particular to center special containers adapted to be assembled in folder-gluer machines.

2. Prior Art

In the manufacture of containers, and in particular fibreboard containers, it is desirable to automate the process as fully as possible in order to reduce costs. Container manufacturers utilize "folder-gluer" machines which receive a box blank in a hopper, fold the blank to form an intermediate blank or "knocked down" container, align or "square up" the blank at a squaring station so that the panels on either side of the joint are aligned, and apply adhesive to the joint to seal the ends of the blank to each other. Such folder-gluer machines are well known in the art.

After adhesive has been applied to the manufacturer's joint in the folding and gluing process, pressure is applied to the joint, usually by rollers, to aid in the sealing of the joint. Prior to the rolling operation and before the adhesive applied to the joint sets up, the folded blank is aligned or "squared up" in a squaring section of the folder-gluer machine. The squaring action may be effected by a pair of opposing vertically disposed platens which contact opposing edges of the folded blank defined by the flaps of the container. In order for the spanking action of the platens to square-up the folded blank effectively, it is necessary that the flaps on both sides of the folded blank be of the same length; otherwise the panels from which the flaps extend will become misaligned as a result of the spanking action and the resultant knocked down blank will be of unacceptable quality.

Accordingly, box blanks used to form regular slotted containers are ideally suitable for use with a folder-gluer machine. A regular slotted container is one in which all of the flaps are the same length. Usually, the flaps are of a length such that the lengthwise flaps -- that is, the flaps extending from the front and rear side panels of the box -- are approximately one-half the length of the end panels so that, when folded, the flaps meet to abut at the center of the box forming a cube.

However, in regular slotted containers which have sides which are not square but rather rectangular, the flaps extending from the end panels, which form the inner flaps of the box, do not abut each other and the container has uneven top and bottom surfaces resulting from the gap between the end flaps. Where it is necessary to provide a slotted container having an even top and/or bottom surface, such as when small containers of food are packed, fill-in pads are provided and are positioned in the gap between the folded inner flaps of the top and bottom surfaces of the box. Another method of providing a flat top or bottom surface is to provide a pad that is inserted into the set up container and covers the entire top or bottom surface of the box. A disadvantage with the use of all such pads is that the cost of the container is increased as a result of the necessity of adding additional pieces to the box and an additional step in the packing of the box in which the pad or pads is placed in the box prior to its being loaded with the items to be packaged.

An alternative container which provides an even top and bottom surface is the center special slotted container. The center special slotted container is similar to the regular slotted container previously described except that the inner flaps which extend from the end panels extend outwardly from the end panels a distance equal to approximately one-half the length of the front and rear side panels so that they meet at the center of the box. The inner flaps thus provide a level rest for the contents of the box without the use of pads. In addition, the center special slotted container is stronger at the top and bottom due to the double thickness of fibreboard in these areas.

However, for certain shapes of blanks, a disadvantage with the center special slotted container is that it is not adapted to be formed in a folder-gluer machine. For example, a blank for a non-square center special slotted container has cover flaps extending from the front and rear side panels which are shorter in length than those extending from the end panels. The blank as presently made consists of four panels: front and rear side panels, an end panel joining the side panels, and a second end panel attached to a side panel opposite the first end panel. The second end panel includes a tab which is overlapped by the end of the noncontiguous side panel when the blank is folded. When processed by a folder-gluer machine, the slapping action of the platens at the squaring station cannot properly align the panels of the folded blank so that the resultant knocked down container is properly squared, since the platens cannot contact both of the panels that overlap to form the joint. As a result, manufacturers who utilize folder-gluer machines to manufacture folded blanks for non-square center special slotted containers experience a high rate of rejection resulting from misalignment of the panels of the container.

Therefore, there is a need for a box blank which can be formed into an intermediate folded blank for a non-square center special slotted container which is adapted to be utilized by a folder-gluer machine without yielding a high rate of rejection. In addition, there is a need for a non-square center special slotted container which is inexpensive to fabricate and does not require additional pieces and the addition of steps in the formation of a box from a blank.

SUMMARY OF THE INVENTION

The present invention provides a blank which can be formed into a non-square center special slotted container and which can be utilized in a folder-gluer machine to be formed into an intermediate folded blank having high quality and a low rate of rejection. The blank of the present invention does not require the addition of extraneous panels or pads to provide a container having level bottom and top surfaces and therefore is as inexpensive to set up as regular slotted containers.

The present invention includes a five panel container blank having a full end panel, first and second side panels joined to the full end panel, and first and second partial end panels, each partial end panel joined to a different one of the first and second side panels. The full end panel has a pair of end flaps extending outwardly from a top and bottom edge of the end panel, each flap having a length approximately equal to one-half the length of the side panels. The first and second partial end panels each have pairs of partial end flaps extending from upper and lower edges thereof, each flap having a length equal to approximately one-half the length of the side panels. In a typical application which requires a center special container of a non-square configuration, the first and second side panels are longer than the end panels and therefore the flaps extending from the side panels are shorter than the end flaps extending from the end panels.

When the blank of the present invention is fed into the hopper of a folder-gluer machine, it is folded to form an intermediate folded blank in which the full end panel and second side panel are coplanar and the first side panel is folded to overlay the full end panel. The first partial end panel is coplanar with the first side panel and the second partial end panel is folded with respect to the second side panel to extend toward the first partial end panel and preferably overlaps the first partial end panel to form a lap joint. Thus, after an adhesive has been applied to the overlapping portions of the first and second partial end panels, the slapping action of the opposing platens in the squaring station causes the platens to contact the pair of full end flaps and the first and second pairs of partial end flaps at the opposite end of the folded blank. Since the first and second partial end panels each have end flaps and these end flaps are of the same length, the slapping action of the platens contacts the end flaps of each partial end panel and can properly align the ends of the folded blank on either side of the joint prior to the rolling step so that the knocked down container is properly squared.

Preferably, the overlapping portion of the lap joint extends the full width of the folded blank: that is, from the bottom of the bottom partial end flaps to the top of the top partial end flaps. The width of the overlapping portion is preferably at least the minimum required by industry standards: approximately one and one-quarter inches. However, the maximum overlap can equal the full width of the end panel in which case each partial end panel would equal the full end panel in length.

Several alternate embodiments of the invention may be utilized and yet provide the advantages of the preferred embodiment. For example, the first or second partial end panel may include a tab extending from a free end thereof such that in the folding operation, the second partial end panel is folded over to form a lap joint in which only the tab is overlapped. In this embodiment, adhesive is applied to the overlapping surface and the resultant box has two separate partial end flaps extending from the top and bottom of the joined end panel. In this embodiment the seal may be affected with metallic stitches or staples.

In a third embodiment, the first and second partial end panels can be sized to form a butt joint which do not overlap when the blank is folded. The partial end panels may be joined by conventional means such as a strip carrying an adhesive. This embodiment would be most useful in a semi-automatic forming operation in which the operator manually folds and squares the blank and the a machine is used to receive the blank and apply the adhesive tape strip to the seam.

A fourth embodiment of the invention is a blank that differs from the earlier discussed embodiment in that the top flap of the full end panel and the top flaps of the first and second partial end panels are shorter in length than their counterparts extending from the bottom of the end panels so that they are equal in length to the adjacent flaps extending from the tops of the side panels.

In this configuration the top flaps of the blank would be of the RSC or regular slotted container type, and the bottom flaps would be of the CSSC or center special slotted container type. The container formed from this blank would have the advantages of CSSC type bottoms while having top or cover flaps designed for special uses. For example, if the cover flaps were short enough, a container made from such a blank would possess a ventilating gap. Alternatively, the cover flaps could be made longer so that a resulting container would have overlapping flaps.

The blank may be fed into a folder-gluer machine and folded to form an intermediate folded blank similar to that previously described. The platens of the folder-gluer machine would contact the bottom end flaps of the full end panel and first and second partial end panels on one side of the folded blank, and all of the top flaps of the side and end panels on the other side. Thus, the slapping action of the platens in the squaring station would contact opposite ends of the end flaps of the partial end panels thereby aligning the ends of the blank properly prior to rolling.

In a fifth embodiment of the invention, a blank is provided which forms a non-square half slotted box of the type used with a telescoping top. The blank is of the five panel design having a full end panel interposed between two side panels and first and second partial end panels, but each panel has a single flap extending from a single side of the blank. Thus, for example, the set-up box would have the aforementioned center special slotted flap design only on a top or a bottom edge.

The advantages of the invention are still present in this embodiment in that when folded to form an intermediate folded blank, the blank would have overlapping partial end panels having equal overall widths, including the flaps, and the same as the full end panel and end flap at the opposite end of the folded blank. When the folded blank is placed into the squaring section of a folder-gluer machine, the vertical platens will contact the edges of the partial end flaps and full end flap on one side and the edges of the partial and full end panels on the other. Thus, the spanking action of the platens will properly align the panels of the blank prior to the drying of the adhesive joining the partial end panels.

Accordingly, it is an object of the present invention to provide a blank for a non-square center special slotted container which can be formed into an intermediate folded blank which can be utilized by a folder-gluer machine for high-speed folding and gluing operation with a low rate of rejection, as well as semi-automatic joining with tape or stitches.

Other objects and advantages of the invention will be apparent from the following description, the accompanying drawings and the appended claims.

DETAILED DESCRIPTION OF THE PREFERRED EMBODIMENTS

Figure 1:
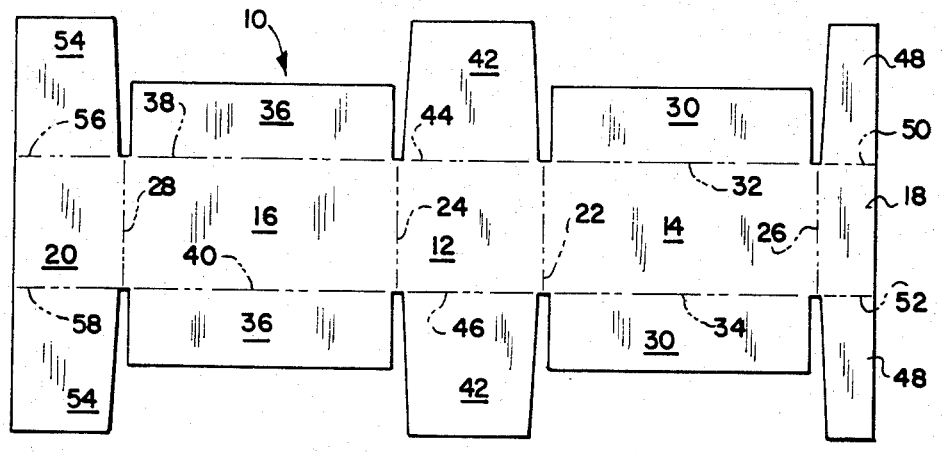
FIG. 1 is a blank embodying the invention.

As shown in FIG. 1, the folded blank of the preferred embodiment of the invention, generally designated 10, is of the five panel variety used to form a non-square center special slotted container. The five panels consist of a full end panel 12, a first or front side panel 14, a second or rear side panel 16, a first partial end panel 18, and a second partial end panel 20. The first side panel 14 and second side panel 16 each are joined to opposite sides of the full end panel 12 at score lines 22, 24, respectively. The first partial end panel 18 is joined to the first side panel 14 at score line 26 which is located at an end of the first side panel opposite score line 22. The second partial end panel 20 is joined to the second side panel 16 at score line 28 which is at an end of the second side panel opposite score line 24.

The first side panel 14 is equal in length, measured from score line 28 to score line 24, to the second side panel 16, measured along the same dimension, and each is greater in length than the length of full end panel 12, measured from score line 24 to score line 22. Thus, the resultant box made from this blank will have a non-square or rectangular configuration.

The first side panel 14 includes a first pair of cover flaps 30 which are joined to the first side panel at score lines 32, 34 which extend along top and bottom longitudinal edges of the panel, respectively. Similarly, the second side panel 16 includes a second pair of cover flaps 36 which are joined to the second side panel at score lines 38, 40 which extend along top and bottom longitudinal edges of the second side panel, respectively. The full end panel 12 includes a pair of full end flaps 42 which are attached to the end panel at score lines 44, 46 which extend along top and bottom longitudinal edges of the full end panel, respectively.

The first partial end panel 18 includes a first pair of partial end flaps 48 which are attached to the first partial end panel at score lines 50, 52 which extend along top and bottom longitudinal edges of the first partial end panel, respectively. The second partial end panel 20 includes a second pair of partial end flaps 54 which extend from the second partial end panel at score lines 56, 58 which extend along top and bottom longitudinal edges of the second partial end panel, respectively. As shown in FIG. 1, the blank 10 is sized so that the first and second side panels 14, 16 each are greater in length, measured in a direction between end panels, than the full end panel 12. As a result, the full end flaps 42, which approximately equal one-half the length of side panels 14, 16, are greater in length than each of the first and second pairs of cover flaps 30, 36. Similarly, the first and second pairs of partial end flaps 48, 54 are equal in length to the full end flaps 42 and are greater in length than the cover flaps 30, 36.

Figure 2:
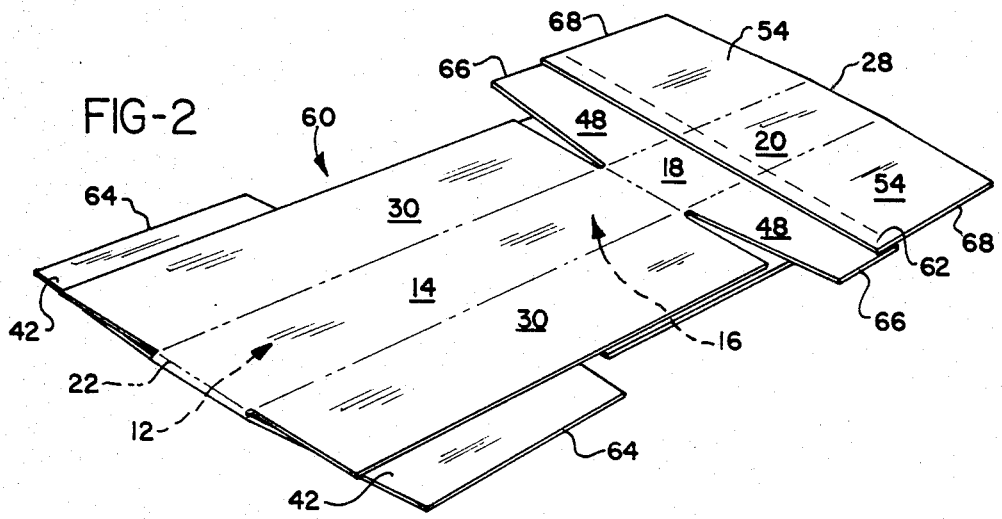
FIG. 2 is a perspective view of the blank of FIG. 1 folded to form an intermediate folded blank in the manner of the invention.

As shown in FIG. 2, an intermediate folded blank, generally designated 60, is made from the blank 10 of FIG. 1 which has been folded along the score line 22 between the first side panel 14 and the full end panel 12, and score line 28 between the second side panel 16 and the second partial end panel 20. In this configuration, the full end panel 12 and the second side panel 16 are coplanar, and the first side panel 14 overlays them. The second partial end panel 20 is folded back toward the first partial end panel 18 and the lengths of the first and second partial end panels are such that the second partial end panel overlaps a portion of the first partial end panel creating a lap joint 62. It is understood that the sequence may be reversed so that the first partial end panel 18 overlaps the second partial end panel 20 to form lap joint 62, without departing from the invention.

Preferably, the minimum width of the overlap, measured from free end to free end of the blank 60, is $1\frac{1}{4}$ inches. The intermediate folded blank 60 is completed by the application of an adhesive (not shown) to the overlapping area of the lap joint 62.

If a blank 10 such as that shown in FIG. 1 were to be fed into the hopper of a folder-gluer machine and folded into the folded blank 60 of FIG. 2, the opposing platens of the squaring station of the folder-gluer machine would contact the folded blank at the outer edges 64 of the full end flaps 42, the outer edges 66 of the first partial end flaps 48, and the outer edges 68 of the second partial end flaps 54. Since the end flaps 42, 48, 54 are equal to each other in length, the action of the platens serves to square up the folded blank 60 so that the first partial end panel 18 is properly aligned with the second partial end panel 20.

Figure 3:
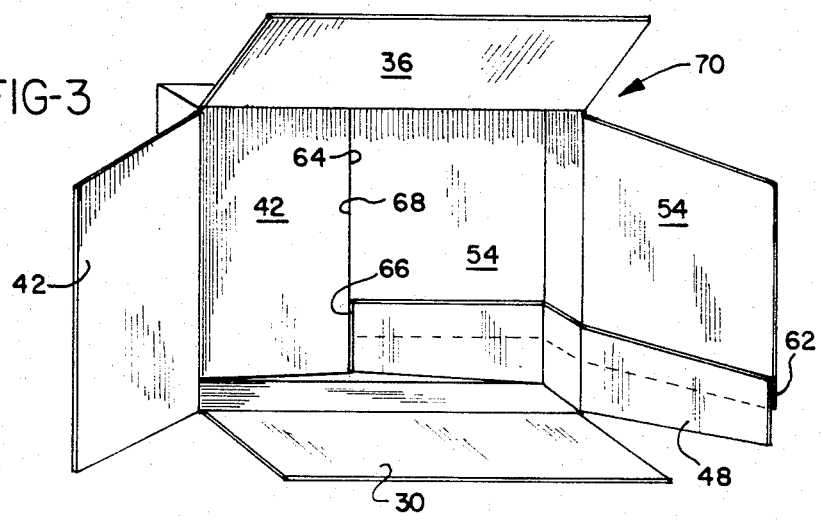
FIG. 3 is a perspective view of a box formed from the intermediate blank of FIG. 2.

As shown in FIG. 3, a box, generally designated 70, made from the intermediate blank 60 shown in FIG. 2 is of the center special variety in which the outer edges 64 of the full end flaps 42 abut the outer edges 66, 68 of the first and second partial end flaps 48, 54 to form a continuous and substantially level bottom and top surfaces of the finished box. The first and second pairs of cover flaps 30, 36 are folded to enclose the end flaps 42, 48, 54. Thus, the center special box provides a level surface for its contents without the need for a pad.

Figure 4:
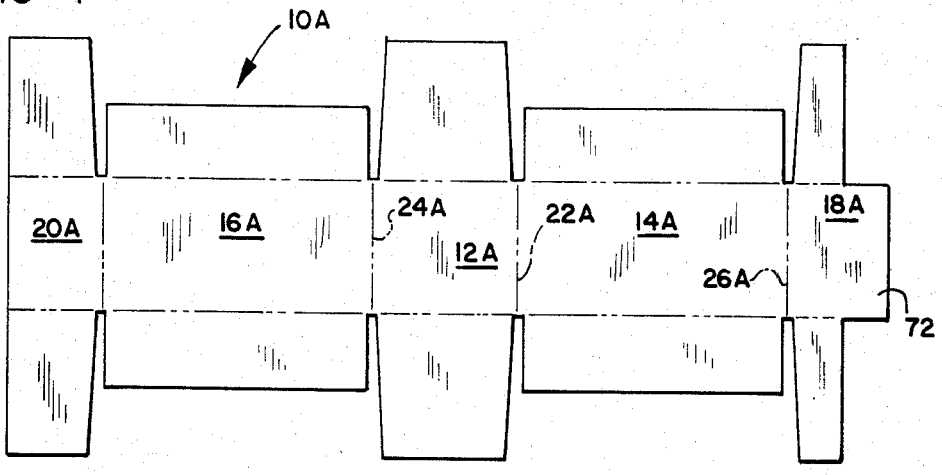
FIG. 4 is a blank of an alternate embodiment of the invention.

An alternate embodiment of the invention is shown in FIG. 4 in which a five panel blank 10A for a non-square center special container consists of a full end panel 12A, first and second side panels 14A, 16A, respectively, first and second partial end panels 18A, 20A, respectively, and includes a tab 72 extending from the first partial end panel at a side opposite score line 26A joining the first partial end panel with the first side panel. In this embodiment, the length of the full end panel 12A is equal to the sum of the lengths of the first and second partial end panels 18A, 20A, less the length of the tab 72.

Figure 5:
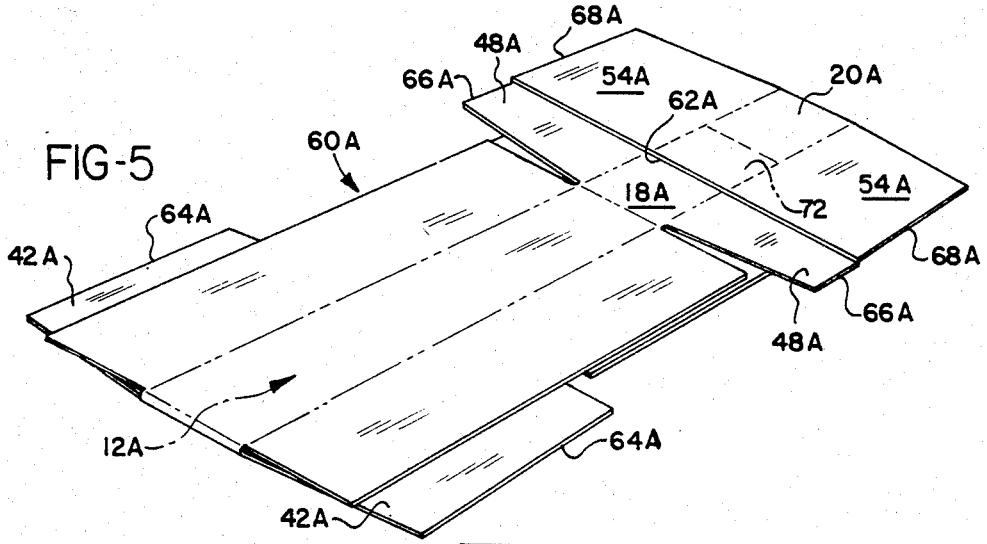
FIG. 5 is a perspective view of the blank of FIG. 4 folded to form an intermediate folded blank in the manner of the invention.

As shown in FIG. 5, the folded blank 60A made from the blank 10A of FIG. 4 is folded in a manner similar to that described for the folded blank 60 of FIG. 2. However, the first and second partial end panels 18A, 20A do not overlap. Rather, the second partial end panel overlaps only the tab 72, shown in phantom to form lap joint 62A; conversely, tab 72 may overlay panel 20A to form an outside lap joint. In forming the blank 10 into a folded blank 60A of FIG. 5, adhesive is applied only to the overlapping contact surface between tab 72 and second partial end panel 20A.

When the blank 10A is fed into a folder-gluer machine to be formed into the folded blank 60A of FIG. 5, the platens of the squaring station would contact the outer edges 64A of the full end flaps 42A, the outer edges 66A of the first partial end flaps 48A, and the outer edges 68A of the second partial end flaps 54A. Again, since these flaps are of the same length, the action of the platens would serve to square up the blank 60A so that the first partial end panel 18A and second partial end panel 20A are properly aligned at the time the adhesive between the tab 72 and the second partial end panel sets.

Figure 6:
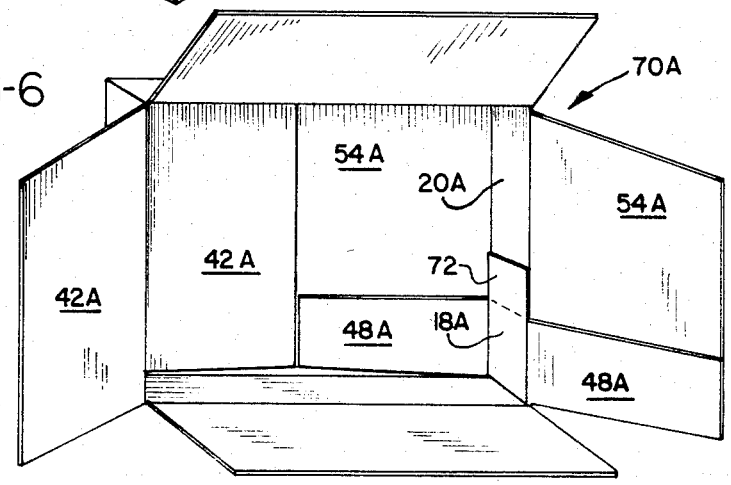
FIG. 6 is a perspective view of a box formed from the intermediate folded blank of FIG. 5.

As shown in FIG. 6, a box 70A formed from the intermediate folded blank 60A of FIG. 5 includes a top and bottom each having inner flaps consisting of the full end flaps 42A, the first partial end flaps 48A, and the second partial end flaps 54A. However, unlike the previously discussed embodiment shown in FIG. 3, the first and second partial end panels 18A, 20A are joined only by tab 72 so that partial end flaps 48A, 54A move freely with respect to each other. The advantages of the center special style design are still retained in the box 70A since the end flaps 42A abut the partial end flaps 48A, 54A to provide a level top and bottom surface which does not have the uneveness of a lap joint 62 (shown in FIG. 3).

Figure 7:
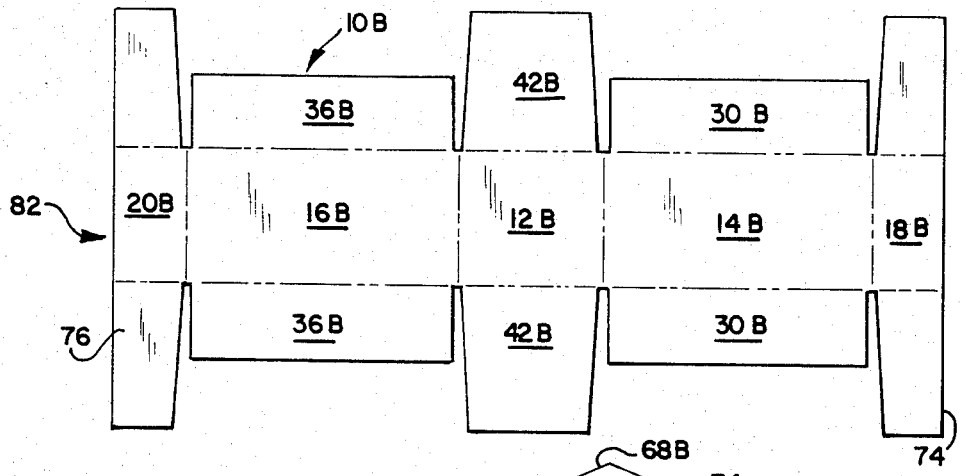
FIG. 7 is a blank of a second alternate embodiment of the invention.

A third embodiment of the invention is shown in FIG. 7 in which a blank 10B is of the same five panel construction described with respect to FIGS. 1 and 4 except that the first and second partial end panels 18B, 20B are of equal length or together equal the length of the full end panel 12B. The arrangement and design of the first and second side panels 14B, 16B, the first and second pairs of cover flaps 36B, 30B, as well as the full end flaps 42B, are similar to that shown for the blank 10 of FIG. 1.

Figure 8:
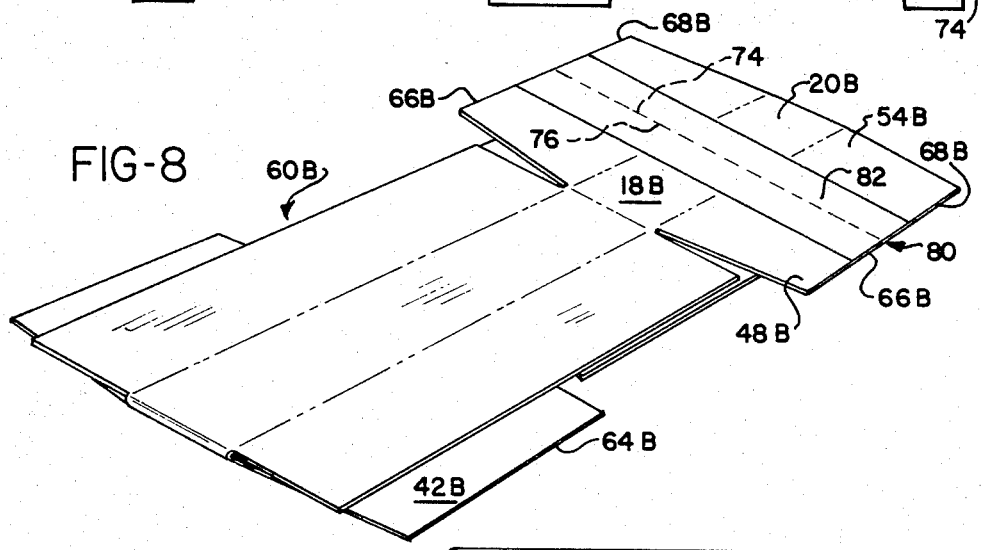
FIG. 8 is a perspective view of the blank of FIG. 7 folded to form an intermediate folded blank in the manner of the invention.

As shown in FIG. 8, the intermediate folded blank 60B of the blank 10B of FIG. 7 is formed in a manner similar to that described for folded blank 60 of FIG. 2. However, the folded blank 60B is distinguishable in that the free ends 74, 76 of the first and second partial end panels 18B, 20B, respectively, abut each other to form a flat seam 80. A suitable means for joining the opposing edges 74, 76 of the first and second partial end panels 18B, 20B can be tape 82 applied to an outside surface of the partial end panels. The tape 82 may extend from the outer edges 66B, 68B of the partial end panels 18B, 20B to the opposing outer edges, or may simply extend the height of the panels.

The blank 10B shown in FIG. 7 is especially suitable for use in a semi-automatic operation. Accordingly, the blank 10B may be manually folded and fed into a taping machine which applies tape 82 and seals the flat seam 80 to form an intermediate folded blank 60B as shown in FIG. 8.

Figure 9:
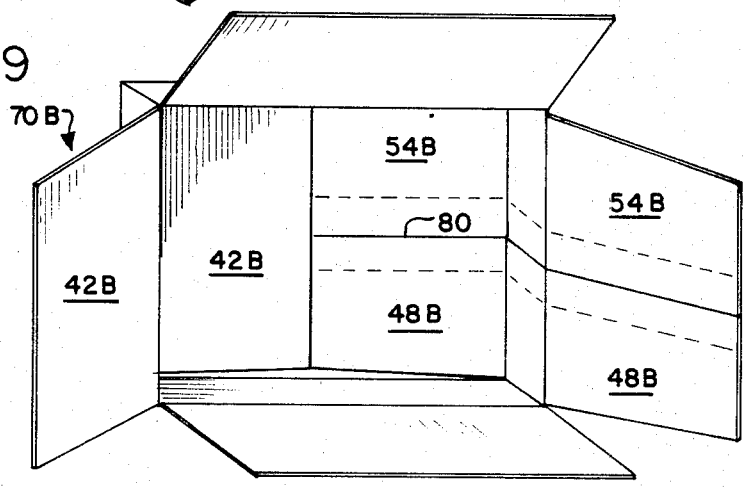
FIG. 9 is a perspective view of a box formed from the intermediate folded blank of FIG. 8.

The resultant box 70B is shown in FIG. 9. The box 70B has the advantages of the center special style in that level top and bottom surfaces are provided consisting of the end flaps 42B, 48B, 54B. The interior of the box 70B lacks any type of protrusion formed by lap joints or tabs and presents only the flat seam 80 which is sealed by tape 82 on the external surface of the box.

Figure 10:
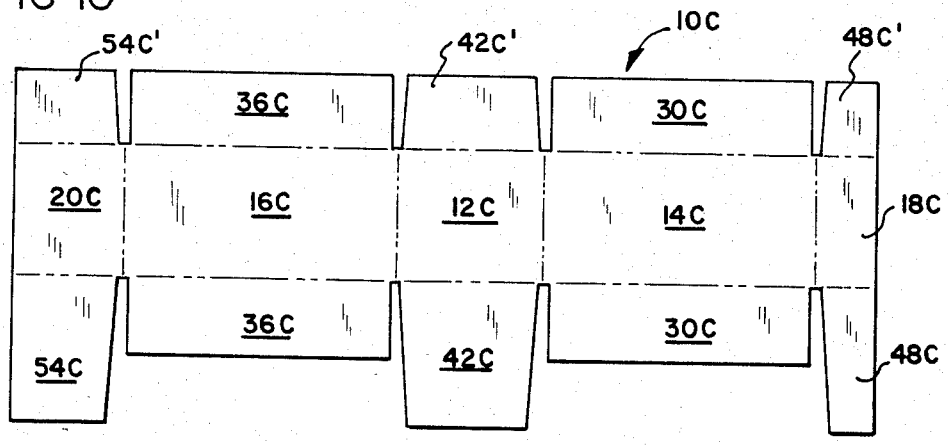
FIG. 10 is a blank of a third alternate embodiment of the invention.

A fourth embodiment of the invention is shown in FIG. 10 which depicts a blank 10C used to form a container having a bottom which is of the center special slotted variety, and a top which is of the regular slotted variety; that is, the partial end flaps 48C', 54C', and the full end flap 42C' are equal in length to the cover flaps 30C, 36C.

Figure 11:
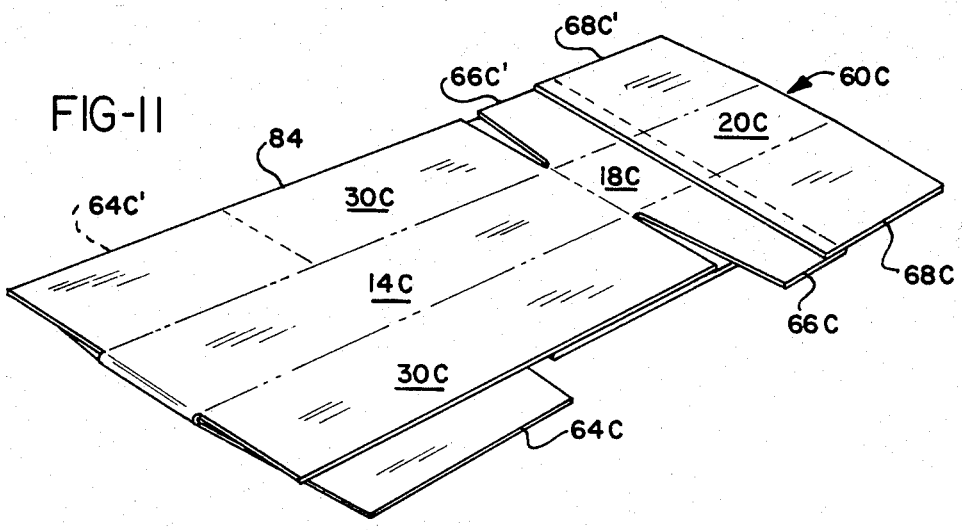
FIG. 11 is a perspective view of the blank of FIG. 10 folded to form an intermediate folded blank in the manner of the invention.

As shown in FIG. 11, the intermediate folded blank 60C of the blank 10C shown in FIG. 10 is formed in a manner similar to that described in reference to the aforementioned embodiments. However, the folded blank 60C is distinguishable in that the outer edges 66C', 68C' of the partial end panels 18C, 20C are aligned with the outer edge 84 of the cover flap 36C. Similarly, the outer edge 64C' of the full end flap 54C' is aligned with the outer edge 84 of the cover flap 36C. However, when the folded blank 60C is presented to the squaring station of a folder-gluer machine, the opposing platens will contact the outer edges 64C, 66C, 68C of the end flaps 42C, 54C, 48C on one side of the folded blank, and will contact the outer edges 64C', 66C', 68C' of the end flaps 42C', 54C', 48C' on the opposite side of the folded blank. In addition, since the end flaps 42C', 54C', 48C' on the latter side are equal in length to the similarly disposed cover flaps 36C, 30C, the platen contacting that side of the folded blank 60C will also contact outer edge 84 of the cover flap 30C and the outer edge (not shown) of cover flap 36C. The folded blank 60C can thus be squared so that partial end panel 20C is properly aligned with partial end panel 18C.

Figure 12:
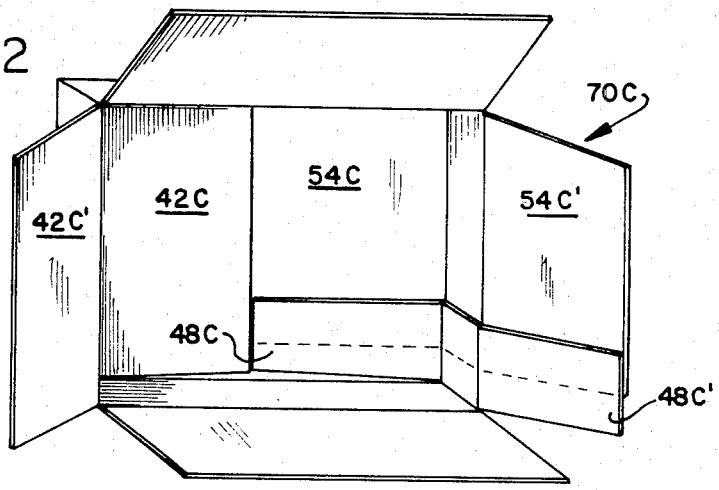
FIG. 12 is a perspective view of a box formed from the intermediate folded blank of FIG. 11.

The box 70C shown in FIG. 12 is similar in construction to the box 70 shown in FIG. 3. Both provide a level bottom surface defined by the center special flaps 42C, 54C, 48C. However, the box 70C shown in FIG. 12 has the shortened end flaps 42C', 54C', 48C' on top which are characteristic of a regular slotted container.

Figure 13:
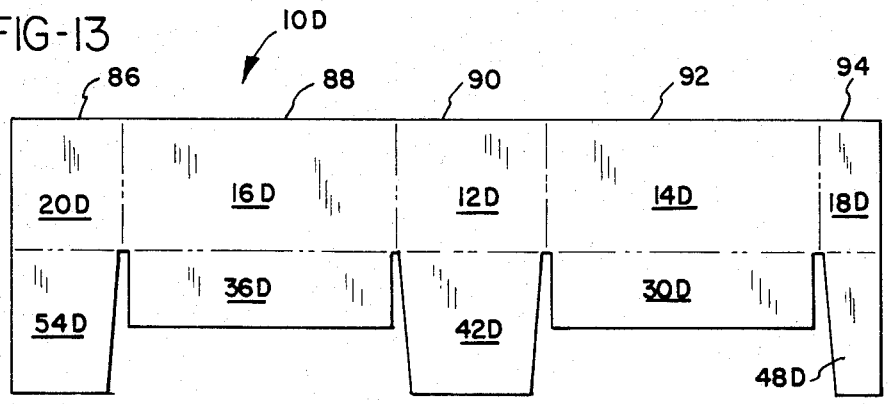
FIG. 13 is a blank of a fourth alternate embodiment of the invention.

A fifth embodiment of the invention is shown in FIG. 13. A blank 10D is of the same five panel construction described with the previous embodiments, except that the blank is designed to form a half slotted box 70D (FIG. 15) which does not have top flaps. Thus, the upper longitudinal edges 86, 88, 90, 92, 94 of the panels 20D, 16D, 12D, 14D, 18D provide an upper longitudinal edge of the intermediate folded blank 60D (FIG. 14) and finished box 70D. The opposite side of the blank includes end flaps 54D, 36D, 42D, 30D, 48D which will provide a center special construction for the bottom of the finished container 70D.

Figure 14:
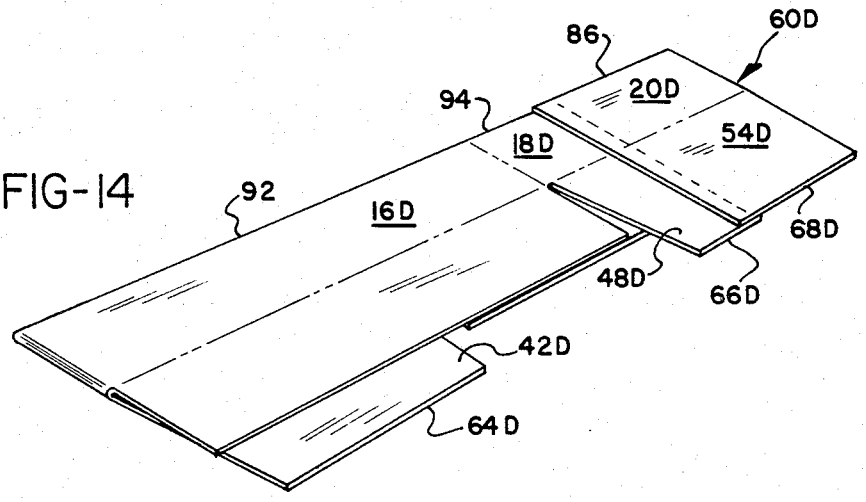
FIG. 14 is a perspective view of the blank of FIG. 13 folded to form an intermediate folded blank in the manner of the invention.

As shown in FIG. 14, the blank 10D is folded to form an intermediate folded blank 60D in which the upper longitudinal edges 92, 94, 86 of panels 16D, 18D, 20D are aligned on one side and provide an outer edge. One the opposite side, the outer edges 64D, 66D, 68D of the full end panel 12D are aligned. Thus, when the blank 60D is placed into the squaring station of a folder-gluer machine, the opposing platens spank the edge formed by the upper longitudinal edges 92, 94, 86, and the lower outer edges of the end panels 64D, 66D, 68D.

Thus, the blank 60D may be properly squared and aligned.

Figure 15:
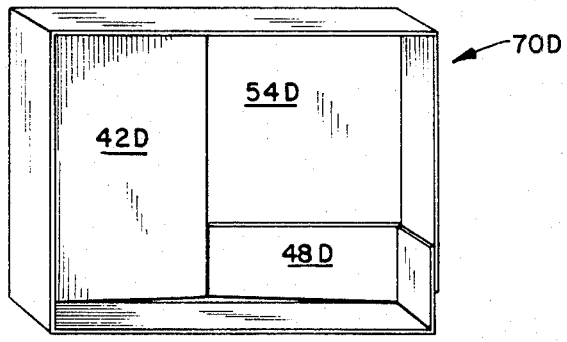
FIG. 15 is a perspective view of a box formed from the intermediate folded blank of FIG. 14.

As shown in FIG. 15, the box 70D made from the intermediate blank 60D of FIG. 14 contains a level bottom surface defined by flaps 42D, 54D, 48D. It should be noted that while the structure shown in FIGS. 13, 14, and 15 is described as being a half slotted box with an open top and a covered bottom, the box so described can just as easily be used to form a telescoping top to a similarly constructed half slotted box having a slightly smaller length and width dimensions to permit telescoping.

Figure 16:
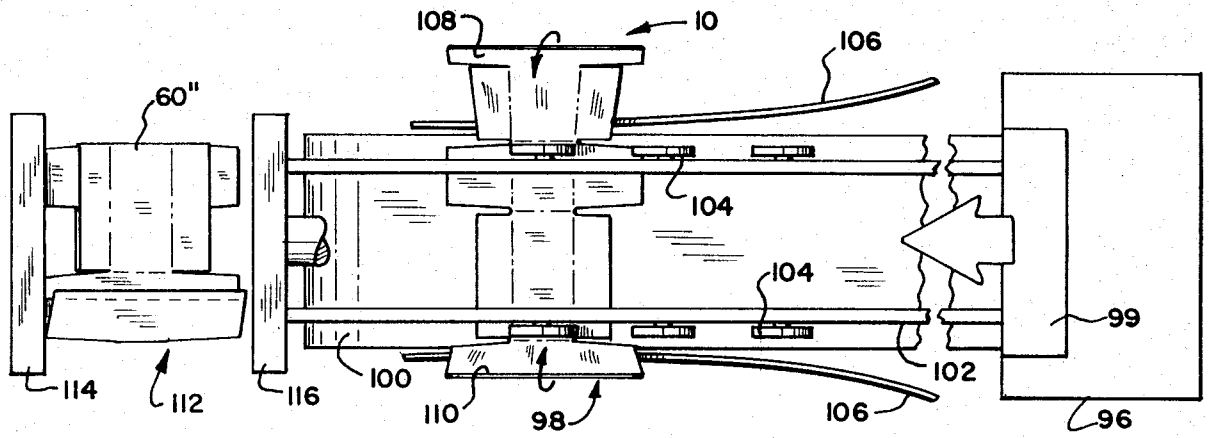
FIG. 16 is a schematic plan view of a typical folder-gluer machine capable of utilizing blanks formed in accordance with the invention.
Figure 17:
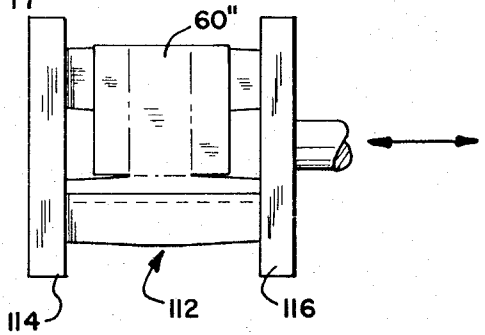
FIG. 17 is a schematic plan view of the squaring section of the folder-gluer of FIG. 16 in which a platen is spanking a folded blank at the bottom of a stack.

The folder-gluer machine represented in FIGS. 16 and 17 is typical of those well-known in the art, such as for example, the Model CL 5400 manufactured by Koppers Company, Inc. of Pittsburgh, Pa.

As shown in FIG. 16, blanks 10 such as those previously described are loaded into a feed hopper 96 which feeds the blanks into a folding section 98. Associated with the feed hopper 96 is a gluer 99 which applies adhesive to a predetermined edge of the blank 10 which will be folded over an opposing edge, as previously discussed. Folding section 98 consists of a conveyor 100 having a plurality of rollers used for transporting the blanks 10 from the feed hopper 96, and a structure 102 having a plurality of freely spinning wheels 104 which are positioned to engage the blank 10 at predetermined score lines along which the blank is to be folded. The folding section 98 also includes a pair of rails 106 which are positioned on either side of the conveyor 100 and are curved to engage the portions of the blank 10 which extend outwardly from the conveyor and are to be folded. As the blank 10 is transported along the conveyor 100, the extending segments 108, 110 extending outwardly from the conveyor engage the rail 106 and are folded over to form an intermediate folded blank 60″ similar to those previously described. The intermediate folded blank 60″ is transported to a squaring station 112 between a fixed platen 114 and a reciprocating platen 116.

As shown in FIG. 16, the folded blank 60″ may be folded improperly in the folding section 98 so that the overlapping panels are not aligned or squared properly.

While positioned between platens 114 and 116 as shown in FIG. 17, the blank 60 is spanked by a reciprocal movement of the platen 116 toward and away from the fixed platen 114. This spanking action causes the platens 114, 116 to contact the opposing outer edges of the folded blank 60″ thereby squaring the blank so that the partial end panels are properly aligned, as shown in FIG. 17. At this time the adhesive, which has been applied to the portion of the partial end panel forming a lap joint, sets up and the folded blank 60″ is retained in its squared shape. The folded blanks 60″ continue to be fed into the squaring section 112 from beneath the movable platen 116. Thus, as long as the distance from the first partial end panel to its respective outer edges equals the distance from the second partial end panel to its correspondingly respective outer edges, the folded blank of the invention will be properly squared in the squaring section of a folder-gluer machine, thereby placing the first and second partial end panels in aligned, partially overlapping relationship.

Although the concepts and advantages of the center special container of the present invention are present regardless of the material chosen to form the box, the invention is especially suitable for use with containers made of fibreboard which may be of corrugated or solid construction. It is understood that the means for joining the partial end panels together may include any means well known in the art in addition to those means described herein, such as by stapling the partial end panels together or by use of stitching.

While the method and forms of apparatus herein described constitute preferred embodiments of this invention, it is to be understood that the invention is not limited to this precise method and forms of apparatus, and that changes may be made in either without departing from the scope of the invention.

What is claimed is:

1. A method of forming an intermediate folded blank for a center special slotted container comprising the steps of:

selecting a blank having a full end panel, a first side panel joined to a side of said full end panel along a score line and having a length greater than that of said full end panel, a second side panel joined to a side of said full end panel along a score line opposite said score line joining said full end panel to said first side panel, said second side panel having a length equal to that of said first side panel, a first full end flap joined to said full end panel along a score line and extending from a longitudinal edge thereof, said first full end flap being substantially equal in length to one-half said lengths of said first and second side panels, first and second cover flaps joined to said first and second side panels, respectively, along score lines and extending from longitudinal edges thereof such that said first and second cover flaps are correspondingly disposed to said full end flap, said first and second cover flaps having lengths less than that of said full end flap, a first partial end panel joined to said first side panel along a score line opposite said score line joining said first side panel to said full end panel, a second partial end panel joined to said second side panel at a score line opposite said score line joining said first side panel to said full end panel, said first and second partial end panels having a combined length at least equal to that of said full end panel, a first partial end flap joined to said first partial end panel along a score line and extending from a longitudinal edge thereof, said first partial end flap being equal in length to and correspondingly disposed to said first full end flap, and a second partial end flap joined to said second partial end panel along a score line and extending from a longitudinal edge thereof, said second partial end flap being equal in length to and correspondingly disposed to said first partial end flap;

folding said blank along one of said score lines joining said full end panel to one of said side panels and along one of said score lines joining one of said partial end panels to a contiguous other one of said side panels such that said partial end panels both overlap said other one of said side panels and are contiguous with respect to each other, thereby forming a folded blank;

squaring said blank by contacting only opposing edges of said blank defined by outer edges of said full end flap and said first and second partial end flaps on one side, and longitudinal edges of at least said end panels on an opposite side of said blank; and sealing said first partial end panel to said second partial end panel.

2. The method of claim 1 wherein said blank selected in said selecting step further comprises third and fourth cover flaps joined along score lines to said first and second side panels, respectively, and extending from longitudinal edges of said side panels opposite said first and second cover flaps, said third and fourth cover flaps having lengths substantially equal to said first and second cover flaps;

a second full end flap joined to said full end panel along a score line and extending from a longitudinal edge thereof opposite said full end flap, said second full end flap having a length at least equal to that of said third and fourth cover flaps;

third and fourth partial end flaps joined to said first and second partial end panels, respectively, along score lines and extending from longitudinal edges of said partial end panels opposite said first and second partial end flaps, said third and fourth partial end flaps having lengths equal to that of said second full end flap; and said squaring step comprises contacting only said opposing edges of said blank defined by outer edges of said full end flaps and said partial end flaps.

3. The method of claim 2 wherein said blank selected in said selecting step further comprises said second full end flap being substantially equal in length to said first full end flap.

4. The method of claim 3 wherein said squaring step comprises slapping said outer edges by a pair of opposing platens.

5. The method of claim 3 wherein:

said folding step includes folding said blank such that portions of said partial end panels overlap to form a lap joint; and said sealing step comprises applying adhesive to one of said portions of said first and second partial end panels prior to said folding step and allowing said adhesive to set up subsequent to said squaring step.

* * * * *